US005788240A

United States Patent [19]

Feinberg

[11] Patent Number: 5,788,240

[45] Date of Patent: Aug. 4, 1998

[54] METHOD OF PLAYING A KENO-TYPE CRAPS GAME

[76] Inventor: Isadore Feinberg, 1717 St. Georges Rd., Dresher, Pa. 19025

[21] Appl. No.: 808,328

[22] Filed: Feb. 28, 1997

[51] Int. Cl.[6] ..... A63F 3/00

[52] U.S. Cl. ..... 273/274; 273/292

[58] Field of Search ..... 273/274, 292, 273/146, 268

[56] References Cited

U.S. PATENT DOCUMENTS

| | | | |
|---|---|---|---|
| 3,533,629 | 10/1970 | Raven . | |
| 3,873,092 | 3/1975 | Fagan . | |
| 4,033,588 | 7/1977 | Watts . | |
| 4,339,798 | 7/1982 | Hedges et al. . | |
| 4,346,900 | 8/1982 | Lamlee | 273/274 |
| 4,756,531 | 7/1988 | DiRe et al. . | |
| 4,836,553 | 6/1989 | Suttle et al. . | |
| 4,902,019 | 2/1990 | Berman | 273/274 |
| 5,178,395 | 1/1993 | Lovell . | |
| 5,192,076 | 3/1993 | Komori . | |
| 5,273,281 | 12/1993 | Lovell . | |
| 5,308,081 | 5/1994 | Bartle | 273/274 |
| 5,340,119 | 8/1994 | Goldfarb . | |
| 5,350,175 | 9/1994 | DiLullo et al. | 273/274 |
| 5,401,024 | 3/1995 | Simunek . | |
| 5,413,351 | 5/1995 | Franklin | 273/274 |
| 5,544,893 | 8/1996 | Jones et al. . | |

*Primary Examiner*—William M. Pierce

*Attorney, Agent, or Firm*—Panitch Schwarze Jacobs & Nadel, P.C.

[57] ABSTRACT

A method of playing a keno-type craps game in which the outcome of possible combinations of two dice are assigned to post positions is provided. The method includes the steps of providing a game for a player to wager on the occurrence or non-occurrence of at least one of a number of outcomes or combination of outcomes of the two dice for at least one post position. A player makes a wager on at least a selected one of the outcomes or combinations of possible outcomes for the at least one post position. An outcome from possible combinations of two dice is generated for the at least one post position for a single game. The generated outcome is assigned to the at least one post position for the single game, and the player's selected one of the outcomes or combination of possible outcomes for the at least one post position is compared to the generated outcome assigned to the at least one post position for the single game. The player is paid if the generated outcome for each of the at least one post position for the single game is in the player selected outcome or combination of possible outcomes for the at least one post position selected by the player.

10 Claims, 3 Drawing Sheets

METHOD OF PLAYING A KENO-TYPE CRAPS GAME

BACKGROUND OF THE INVENTION

The present invention relates to a new casino game, and more particularly, to a keno-type craps game in which the player wagers on the possible combinations of two dice.

During the past fifty years, no new table games have been introduced into casinos which have competed successfully with the established games such as blackjack, craps, roulette or baccarat. However, the known table games all favor the casino to win on each play, and to the extent that better odds can be obtained by an intelligent player, the odds of winning are still overwhelmingly in favor of the casino. Additionally, novice players are quickly fleeced of their money without receiving any entertainment value, often resulting in a lack of repeat customers at casinos.

Some attempts have been made to provide more excitement and to obtain frequent, loyal, repeat customers in casinos by providing gaming devices which increase the player's odds of winning. However, the only known device is in the form of a slot-type machine, which has not been adopted in any consequential numbers.

The known device increases a player's odds of winning by providing a slot machine with five wheels or reels, with each including twenty stop positions. The player selects from one through five numbers corresponding to each of the wheels. If any one of the one through five pre-selected numbers come up on any one of the five wheels, the player wins, with the payout being determined by the number of pre-selections made by the player, the probability of a hit, and the number of matches with the numbers which come up on the five wheels. Payback from the machine can be as high as 86.5% to 97.3% depending upon the numbers selected. The hit frequency also can be varied from 22% to 76%, providing a high frequency of winning events, with bonuses being provided for selecting numbers in the correct positions and for multiple occurrences of the same number. This increases player excitement and encourages repeat play.

In order to attract more repeat customers to casinos, it would be desirable to provide a game which provides the excitement of the current casino table games, yet provide the player with a greater opportunity to win, or at least limit a player's loss to a reasonable amount. This will provide a player with entertainment value for the amount of time played at a reasonable cost along with the possibility of winning large prizes in order to attract new, loyal, frequent and intelligent players to table games which do not require a high level of skill, such as craps, yet still use a familiar gaming medium.

SUMMARY OF THE INVENTION

Briefly stated, the present invention provides a method of playing a keno-type craps game in which the outcome of possible combinations of two dice are assigned to post positions. The method comprises the steps of:

(a) providing a game for a player to wager on the occurrence or non-occurrence of at least one of the following outcomes or combination of outcomes for at least one post position:

Appearance of Seven,
Non-Appearance of Seven,
Whirl Numbers (2-3-7-11-12),
Horn Numbers (2-3-11-12),
Odd Numbers (3-5-7-9-11), Even Numbers (2-4-6-8-10-12),
Inside Numbers (5-6-8-9),
Outside Numbers (4-5-9-10),
Seven and Inside Numbers (5-6-7-8-9),
Seven and Outside Numbers (4-5-7-9-10),
All Place Bet Numbers (4-5-6-8-9-10),
Seven and Over (7-8-9-10-11-12),
Seven and Under (2-3-4-5-6-7),
Seven & Even Numbers (7-2-4-6-8-10-12),
Seven & All Pairs (7 & 1—1, 2—2, 3—3, 4—4, 5—5, 6—6)
Any Specific Number, and
Any Combination of Numbers;

(b) a player making a wager on at least a selected one of the outcomes or combinations of possible outcomes for the at least one post position;

(c) generating an outcome from possible combinations of two dice for the at least one post position for a single game;

(d) assigning the generated outcome to the at least one post position for the single game;

(e) comparing the player selected one of the outcomes or combination of possible outcomes for the at least one post position to the generated outcome assigned to the at least one post position for the single game; and (f) paying the player if the generated outcome for each of the at least one post position for the single game is in the player selected outcome or combination of possible outcomes for the at least one post position selected by the player.

In another aspect, the present invention provides a method of playing a keno-type craps game in which the outcome of possible combinations of two dice are assigned to six post positions. The method comprises the steps:

(a) providing a game board for a player to wager on the occurrence or non-occurrence of at least one of the following outcomes or combination of outcomes for each of the six post positions:

Appearance of Seven,
Non-Appearance of Seven,
Whirl Numbers (2-3-7-11-12),
Horn Numbers (2-3-11-12),
Odd Numbers (3-5-7-9-11),
Even Numbers (2-4-6-8-10-12),
Inside Numbers (5-6-8-9),
Outside Numbers (4-5-9-10),
Seven and Inside Numbers (5-6-7-8-9),
Seven and Outside Numbers (4-5-7-9-10),
All Place Bet Numbers (4-5-6-8-9-10),
Seven and Over (7-8-9-10-11-12),
Seven and Under (2-3-4-5-6-7),
Seven and Even Numbers (2-4-6-7-8-10-12),
Seven and All Pairs (7 & 1—1, 2—2, 3—3, 4—4, 5—5, 6—6)
Any Specific Number, and
Any Combination of Numbers;

(b) a player making a wager on a selected one of the outcomes or combinations of possible outcomes for each of the six post positions;

(c) generating an outcome from possible combinations of two dice for each of the six post positions for a single game;

(d) assigning the generated outcomes to the six post positions for the single game;

(e) comparing the player selected one of the outcomes or combination of possible outcomes for the each of the six post positions to the generated outcomes assigned to the six post positions for the single game;

(f) paying the player for each of the post positions for the single game which matches the player selected outcome or combination of possible outcomes for each of the six post positions selected by the player, and paying the player a bonus based on the number of winning post positions greater than one.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. The drawings are for the purpose of illustrating the present invention which is not limited to the devices and instrumentalities shown.

In the drawings.

DETAILED DESCRIPTION OF THE INVENTION

Figure 1:
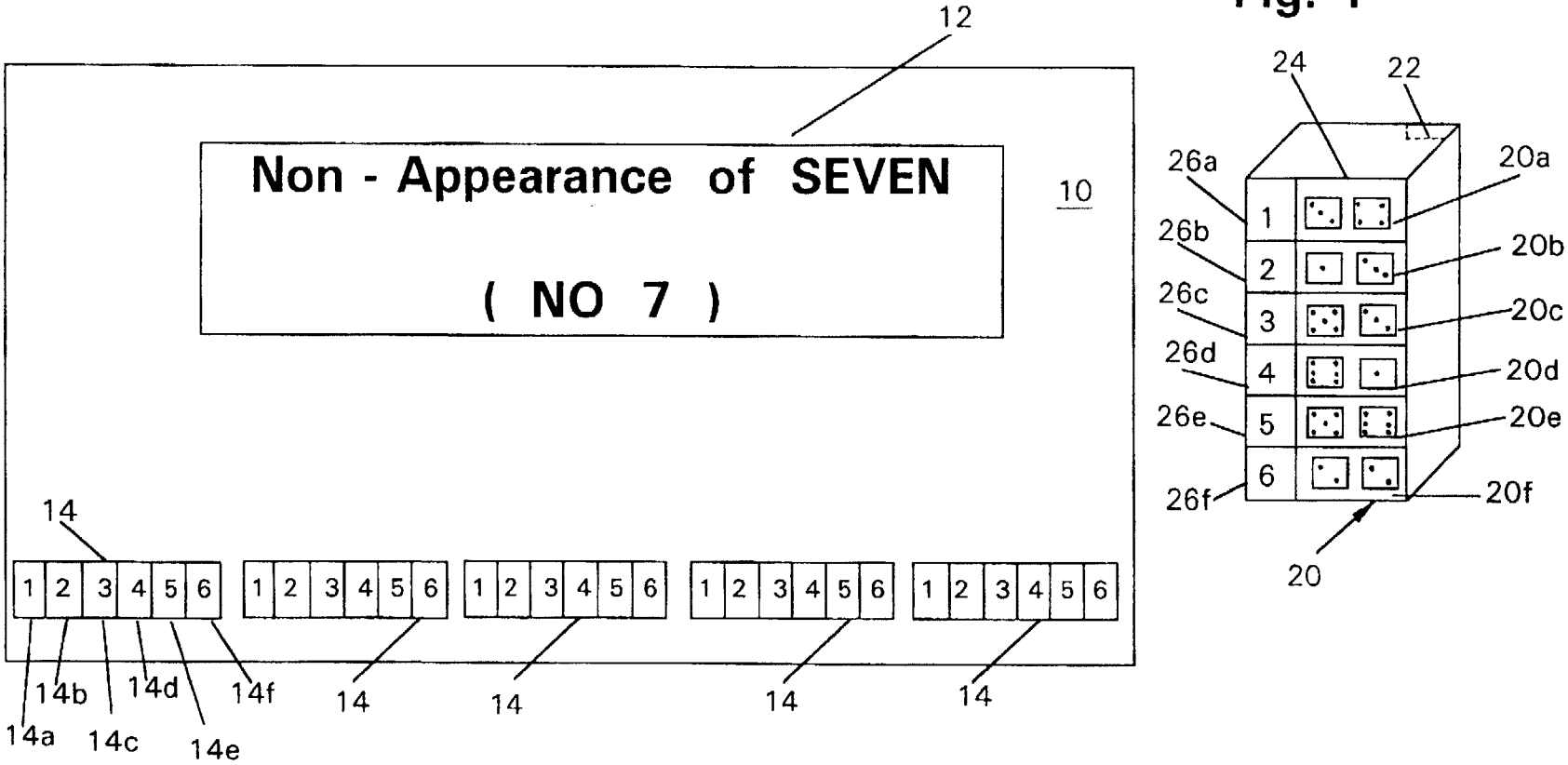
FIG. 1 is a plan view of a first embodiment of a game board and display used in conjunction with the method of playing a Keno-Type Craps game in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the game board 10 which is preferably used in conjunction with the method of playing a Keno-Type Craps Game in accordance with the present invention and designated parts thereof. The terminology includes the words above specifically mentioned, derivatives thereof and words of similar import.

Referring now to FIG. 1, there is shown a game board 10 in accordance with a first preferred embodiment of the invention which is used in conjunction with a method of playing a keno-type craps game in which outcomes 12 of the thirty-six possible combinations of two dice are assigned to post positions 14*a*, 14*b*, 14*c*, 14*d*, 14*e*, 14*f*. The game board is preferably used by a player as part of a game to wager on the occurrence or non-occurrence of at least one of the following outcomes 12 or combinations of outcomes 12 for at least one post position 14*a*. The possible outcomes 12 are selected from one or more of the following: Appearance of Seven, Non-Appearance of Seven, Whirl Numbers (2-3-7-11-12), Horn Numbers (2-3-11-12), Odd Numbers (3,5,7,9,11), Even Numbers (2-4-6-8-10-12), Inside Numbers (5-6-8-9), Outside Numbers (4-5-9-10), Seven and Inside Numbers (5-6-7-8-9), Seven and Outside Numbers (4-5-7-9-10), All Place Bets (4-5-6-8-9-10), Seven and Over (7-8-9-10-11-12), Seven and Under (2-3-4-5-6-7), Seven and Even Numbers (2-4-6-7-8-10-12), Seven and all Pairs (1—1, 2—2, 3—3, 4—4, 5—5, 6—6, 7), Any specific Number, and Any Selected Combination of Numbers. These numbers and combinations of outcomes 12 are described using Craps terminology, however, any possible combination can be used.

In the first preferred embodiment shown in FIG. 1, the game board 10 is used for betting on the Non-Appearance of Seven. A player makes a wager on at least one post position 14*a*, and can wager on more than one post position 14*a*, 14*b*, 14*c*, 14*d*, 14*e*, 14*f* on at least one of the outcomes or combinations of possible outcomes 12 for the at least one post position 14*a*, 14*b*, 14*c*, 14*d*, 14*e*, 14*f*. In conjunction with the game board 10, shown in FIG. 1, preferably wagering is limited to the non-appearance of seven for each post position 14*a*–14*f*, for example, by the player placing a wager within the post position box 14 for a non-appearance bet. It would also be possible to include wagers for the appearance of seven using the same game board 10 by placing a wager above the box for an appearance bet. However, it will be recognized by those skilled in the art from the present disclosure that wagering areas can be provided for any of the above-listed outcomes 12, either at the same table, or at separate tables in order to allow faster play. The use of the term "game board" is intended to encompass gaming tables, boards, video displays, cards or tickets which allow a player to designate a selected outcome 12 for a game, and is not limited to the specific game board design shown in the first preferred embodiment illustrated in FIG. 1.

After the player has placed his wagers for the selected post positions 14*a*, 14*b*, 14*c*, 14*d*, 14*e*, 14*f*, generated outcomes 20 are generated from possible combinations of two dice for the at least one post position 14*a*, 14*b*, 14*c*, 14*d*, 14*e*, 14*f*, and preferably for all six post positions 14*a*–14*f* for a single game. The generated outcomes 20 are preferably selected by a random number generator 22 located within or connected to a display 24 which displays the generated outcome 20*a*, 20*b*, 20*c*, 20*d*, 20*e*, 20*f* adjacent to indicia 26*a*, 26*b*, 26*c*, 26*d*, 26*e*, 26*f* which correspond to each post position 14*a*–14*f* on the game board 10. However, it will be recognized by those skilled in the art from the present disclosure that a continuous stream of generated outcomes 20 can be displayed, and the display 24 is not limited to a specific number of outcomes.

The random number generator 22 is of the type generally known to those skilled in the art and is programmed to provide the same probabilities of generated outcomes 20*a*–20*f* as actually tossing a pair of dice. Preferably, the random number generator 22 generates a continuous flow of craps numbers at a selected rate per hour, such as 3600 per hour or to any practical rate desired by a casino or game operator. An operator preferably controls when the display is cleared of the previous game's outcomes and a new set of outcomes is displayed in order to allow time for a player to place bets and to allow the operator time to collect the players losses and pay out on winning post positions 14*a*–14*f*. This allows the rate of play to be adjusted to be faster or slower, depending on the players' needs.

For example, the game can be operated by selecting six numbers at a specific rate. A casino or operator can set an arbitrary rate for games to be played, such as eight games having six outcomes 20 per hour. The random number generator 22 can be set to generate 400 generated outcomes 20 per hour. The operator, or a player can then select from any of the multitude of generated outcomes 20 being offered as the starting point for a game of six consecutive generated outcomes 20. In the event that the player selects the starting point for a game, and the player would have to designate ahead of time which number in the sequence should be used to start each particular game, using a designated code number. Players can then play as many or as few games as desired.

Figure 2:
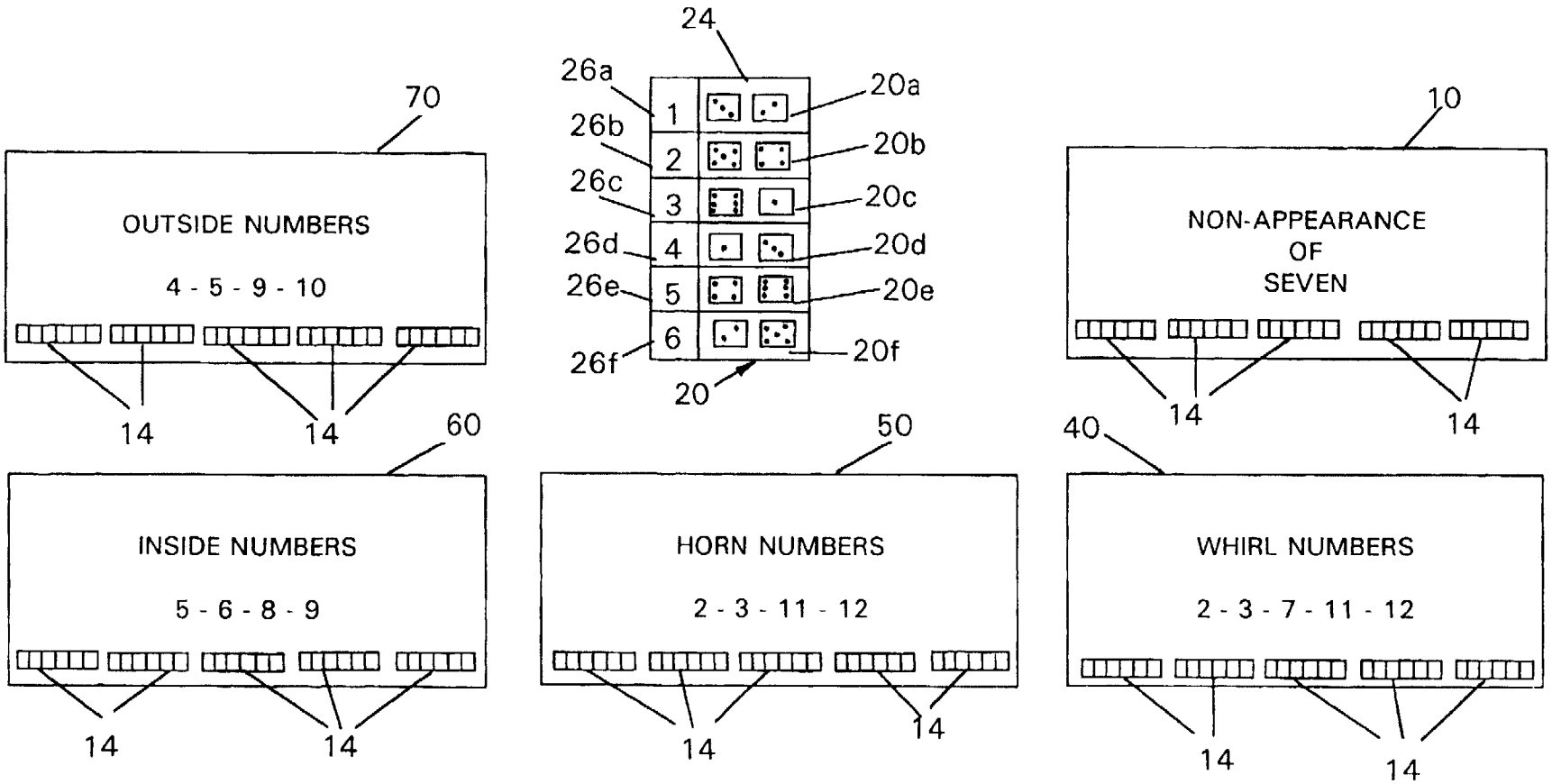
FIG. 2 is a plan view of several game boards and a single display used in conjunction with the method of playing a Keno-Type Craps game in accordance with the present invention.

Additionally, as shown schematically in FIG. 2, a single display 24 of generated post position outcomes 20a–20f can be used in conjunction with several game boards 10, 40, 50, 60, 70, with each game board 10, 40, 50, 60, 70 being used by the players to wager on the appearance or non-appearance of one or more selected outcomes 12 or combination of outcomes 12 noted above for the selected post positions 14a–14f in the post boxes 14. For example, the game board 40 is the same as the game board 10, except that the outcome 12 which can be wagered on is changed. The game board 40 is used to wager on the appearance or non-appearance of the Whirl Numbers for the selected post positions 14a–14f. Similarly, the game board 50 outcome 12 is for wagering on the appearance or non-appearance of the Horn Numbers for the selected post positions 14a–14f. The game board 60 is for wagering on the appearance or non-appearance of the Inside Numbers for the selected post positions. The game board 70 is for wagering on the appearance or non-appearance of the Outside Numbers at the selected post positions 14a–14f. Those skilled in the art will recognize from the present disclosure that the number and arrangement of the game boards 10, 40, 50, 60, 70, and the selected outcomes 12 can be varied, if desired, and that in a casino environment, the game boards 10, 40, 50, 60, 70 are preferably in the form of gaming tables where the players can be preferably seated, in a similar manner to a blackjack table.

It will also be recognized by those skilled in the art from the present disclosure that the outcomes 20a–20f which are generated for a given game can be selected in a different manner, such as actually tossing two dice and displaying or calling the results. For example, the outcomes 20a–20f for each post position can also be selected from a deck of cards (not shown) containing 36 cards with each bearing indicia representative of one of the thirty-six possible outcomes from tossing a pair of dice. However, since the odds would change each time a card is selected and removed from the deck, it would be preferable to use at least ten or more decks of such cards shuffled together, and preferably eleven decks, to at least minimize the shift in the odds. The cards could be dealt separately to each player or dealt only to the dealer in order to speed up play. Those skilled in the art will recognize that the method of outcome selection can be greatly varied, and the particular method selected is within the scope of the present invention. Additionally, while the first game board 10 is represented in FIG. 1 and described as including six post positions 14a–14f, the number of post positions provided can also be varied.

The first generated outcome 20a is assigned to the at least one post position 14a for a single game, and preferably multiple generated outcomes 20a–20f are assigned to the post positions 14a–14f for each game. The player selected one of the outcomes 12 or combinations of outcomes 12 for the at least one post position 14a–14f, and preferably for each selected post position 14a–14f, is compared to the generated outcome 20a–20f displayed on the display 24 adjacent to the indicia 26a–26f which is assigned to the at least one post position 14a–14f for a single game.

The player is then paid if the generated outcome 20a–20f for each of the at least one post positions 14a–14f for the single game is in the player selected outcome or combination of outcomes for the at least one post position 14a–14f selected by the player. For example, in FIG. 1 if the player bet on the non-appearance of seven for the first post position 14a by placing a wager in the box 14 for post position 14a, the player would lose since the generated outcome 20 for the first post position 14a is seven, as shown adjacent to the indicia 26a on the display 24.

If the player had placed a wager on the first, second and third post positions 14a, 14b, 14c, the player would lose for the first post position 14a, as noted above, and win on the second and third post positions 14b, 14c. The comparison and payoff would be made for each player selected post position 14a–14f.

The payoff to the player is determined based on the number of post positions 14a–14f for which the generated outcome 20a–20f matches the player selected outcome 12 or combination of outcomes 12 and the specific outcome 12 selected, based on the probability of winning.

The payoff to the player is preferably greater than 90% of the true payoff based on the odds of the selected outcome 12 or combination of outcomes 12 occurring. The high percentage of the payoff to the player combined with high win percentages encourages continued play and repeat play, providing entertainment value to the player for the wagers lost to the operator or casino. Based on this, it is anticipated that the game will have a high popularity and attract large numbers of players.

For example, a game board can be provided for Seven and Inside numbers (5-6-7-8-9). Table I illustrates the probability, true payoff, actual payoff and house win percentage which is utilized in a preferred embodiment of the invention for Seven and Inside Numbers.

TABLE I

| Number Of Post Wins | Probability 1 in | True Payoff For $5 Wager | Actual Payoff For $5 | Win Percentage % |
|---|---|---|---|---|
| 6 | 11.39 | 56.95 | 55 | 3.43 |
| 5 | 7.59 | 37.97 | 37 | 2.55 |
| 4 | 5.06 | 25.31 | 24 | 5.19 |
| 3 | 3.375 | 16.88 | 16 | 5.21 |
| 2 | 2.25 | 11.25 | 11 | 2.22 |
| 1 | 1.50 | 7.50 | 7 | 6.67 |

Similarly, if the game board 10 is provided for the outcomes 12 of Seven and Under (2-3-4-5-6-7) and/or Seven and Over (7-8-9-10-11-12), the probability of winning and the suggested payoffs and win percentages are provided in Table II below

TABLE II

| Number Of Post Wins | Probability 1 in | True Payoff For $5 Wager | Actual Payoff For $5 | Win Percentage % |
|---|---|---|---|---|
| 6 | 25.38 | 126.90 | 123 | 3.07 |
| 5 | 14.81 | 74.03 | 72 | 2.74 |
| 4 | 8.64 | 43.18 | 42 | 2.74 |
| 3 | 5.04 | 25.19 | 24 | 4.72 |
| 2 | 2.94 | 14.69 | 14 | 4.72 |
| 1 | 1.71 | 8.57 | 8 | 6.67 |

It will be recognized by the skilled artisan from the present disclosure that the payoffs suggested in Tables I and II above are only suggested, and can be varied, if desired. It will be similarly understood that actual payouts of over 90% can be provided for the other outcomes 12, noted above.

This can result in very large bonus prizes being offered to players, especially on a single number bet, such as the appearance of seven for more than one post position. The odds of seven appearing at all six post positions in a single game are 1 in 46,656. For example, a player can wager $5 that the generated outcome 20 selected by the random number generator 22, or by the other means discussed above, will appear consecutively up to and including any selected post position 14a, 14b, 14c, 14d, 14e, 14f. If the player wagers that the generated outcomes 20 will be seven for all six post positions 14a–14f, hitting on all six post positions 14a–14f could result in a bonus payoff of an arbitrarily selected amount which is less than the true payoff, which would be $233,280 for the $5 wager. Preferably a large percentage of the true payoff is actually paid out, for example $233,000, which would be 99.88% of the true payoff. However, large payoffs of this type are preferably payed as a smaller initial sum and an annuity in order provide additional profit for the operator or casino. If the generated outcomes 20 never occur in a sequence which would generate such a large payoff, this would result in additional casino profit.

Figure 3:
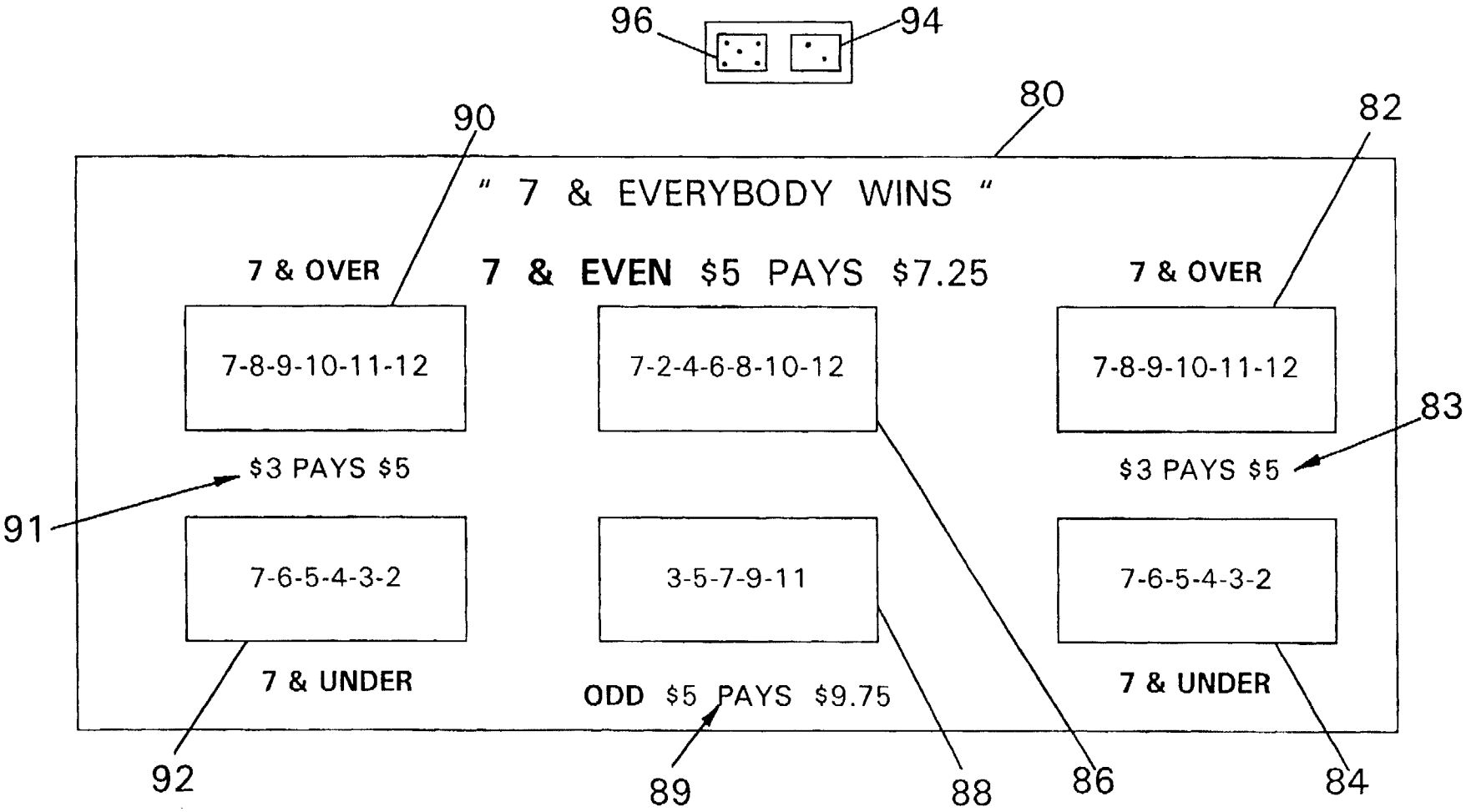
FIG. 3 is a plan view of a game board in accordance with a second preferred embodiment of the present invention.

Referring now to FIG. 3, a game board 80 in accordance with a second preferred embodiment of the invention is provided. The game board 80 is preferably used for wagering on the possible outcomes 12 of the first post position 14a only, and the wagering areas 82, 84, 86, 88, 90, 92 are not delineated into separate post positions as in the first embodiment. All of the selected outcomes in the third preferred embodiment include the number seven, and the game is preferably called "7 & Everybody Wins". A single display 94 with a random number generator which generates generated outcomes 96 with the same probability as rolling two dice is preferably provided. The game board 90 can also be used in a multiple game board environment, as shown in FIG. 2, with only the generated outcome 20a for the first post position 14a being used for a single game. Payoffs 83, 87, 89, 91 can be listed on the game board 90, with the payoffs being greater than 90% of the true payoff based on the probability of the occurrence of a selected outcome 82, 84, 86, 88, 90, 92. Preferably all of the selected outcomes 82, 84, 86, 88, 90, 92 provide odds that the player will win 50% or more of the time to encourage continued and repeat play.

In any of the above games, the players losses can be limited to a fixed amount per hour, such as $7/hour, in order to encourage a player to continue play even during a streak of bad luck. Alternatively, losses can be limited to a percentage, such as 5–15%, of the total amount wagered by the player in order to encourage continued play and repeat play. For example, the player can pay for a group or series of specific games, such as 20 games for $20. The operator or casino can guarantee that the player will not lose more than $3 for the 20 games, providing a minimum of 85% return to the players. However, it will be recognized by those skilled in the art from the present disclosure that other percentages could be used, if desired.

While the present invention has been disclosed in terms of a board game with wagers being placed on selected post positions 14a–14f, it will be recognized by those skilled in the art from the present disclosure that it could be used in connection with three or more dice, or a random number generator which selects numbers from a predefined group of any size. Additionally, the game could be used in connection with video games or slot machines in order to automate play, and is not limited to the preferred board game disclosed.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A method of playing a craps game in which outcomes of possible combinations of numbers which appear on two dice are assigned to post positions, comprising the steps of:

(a) providing at least one of dice, cards and a random number generator for providing an occurrence of outcomes and a game layout demarcated with areas for one or more players to wager on an occurrence of the following outcomes or combination of outcomes for at least one post position:

Odd Numbers (3-5-7-9-11),
Seven and Over (7-8-9-10-11-12),
Seven and Under (2-3-4-5-6-7), and
Seven & Even Numbers (7-2-4-6-8-10-12), (b) each player making a wager on at least a selected one of the outcomes or combinations of possible outcomes for the at least one post position;

(c) generating an outcome from the possible combinations of the numbers which appear on two dice for the at least one post position for a single game;

(d) assigning the generated outcome to the at least one post position for the single game;

(e) comparing the outcomes or combination of outcomes selected by each player for the at least one post position to the generated outcome assigned to the at least one post position for the single game;

(f) if the outcome does not total seven, paying each player only if the generated outcome for each of the at least one post position for the single game is in the player selected outcome or combination of possible outcomes for the at least one post position selected by the player; and (g) if the outcome for the at least one post position totals seven, paying all players who wagered on the at least one post position.

2. The method of claim 1 wherein there are multiple post positions and the player wagers on a selected one of the outcomes or combinations of outcomes for at least one of the multiple post positions, and wherein the payoff to the player is determined based on the number of post positions for which the generated outcome matches the player selected outcome or combination of possible outcomes and the specific outcome or combination outcomes selected.

3. The method of claim 2 wherein there are six post positions and the player wagers on the appearance of the one of the outcomes or combinations of outcomes for at least one and up to six post positions, and if the generated outcomes match the selected one of the outcomes or combinations of outcomes for the at least one of the player selected post positions, paying the player for each post position in which the generated outcome matches the player selected outcome or combination of outcomes.

4. The method of claim 1 wherein a number of outcomes per hour generated by the one of the dice, the cards and the random number generator is regulated.

5. The method of claim 1 wherein at least one deck of cards having indicia representative of the thirty-six possible outcomes of a pair of dice are provided for generating the outcomes and a card from the at least one deck of cards is selected for each post position.

6. The method of claim 1 wherein the payoff to the player is greater than 90% of true payoff based on the odds of the selected outcomes or combination of outcomes selected.

7. The method of claim 1 further comprising the steps of tracking a number of losses of a player per unit time, and paying a rebate to the player based on a difference between the player's actual losses per unit of time and a predetermined maximum loss limit per unit time.

8. The method of claim 1 wherein the game layout is provided with areas for wagering consisting of seven and over, seven and under, seven and even numbers, and odd numbers, and each of the players selects one of seven and over, seven and under, seven and even numbers, and odd numbers for the at least one post position.

9. A method of playing a craps game in which outcomes of possible combinations of numbers which appear on two dice are assigned to post positions, comprising the steps of:

(a) providing at least one of dice and a random number generator for providing an occurrence or non-occurrence of outcomes and a game layout demarcated with areas for a player to wager on an occurrence or non-occurrence of at least one of the following outcomes or combination of outcomes for at least one post position:

Appearance of Seven,
Non-Appearance of Seven,
Whirl Numbers (2-3-7-11-12),
Horn Numbers (2-3-11-12),
Odd Numbers (3-5-7-9-11),
Even Numbers (2-4-6-8-10-12),
Inside Numbers (5-6-8-9),
Outside Numbers (4-5-9-10),
Seven and Inside Numbers (5-6-7-8-9),
Seven and Outside Numbers (4-5-7-9-10),
All Place Bet Numbers (4-5-6-8-9-10),
Seven and Over (7-8-9-10-11-12),
Seven and Under (2-3-4-5-6-7),
Seven & Even Numbers (7-2-4-6-8-10-12),
Seven & All Pairs (7 & 1—1, 2—2, 3—3, 4—4, 5—5,6—6)
Any Specific Number, and
Any Combination of Numbers;

(b) a player making a wager on at least a selected one of the outcomes or combinations of possible outcomes for the at least one post position;

(c) generating an outcome from the possible combinations of numbers which appear on two dice for the at least one post position for a single game;

(d) assigning the generated outcome to the at least one post position for the single game;

(e) comparing the player selected one of the outcomes or combination of outcomes for the at least one post position to the generated outcome assigned to the at least one post position for the single game;

(f) paying the player if the generated outcome for each of the at least one post position for the single game is in the player selected outcome or combination of possible outcomes for the at least one post position selected by the player; and (g) tracking a number of losses of a player per unit time, and paying a rebate to the player based on a difference between the player's actual losses per unit of time and a predetermined maximum loss limit per unit time.

10. A method of playing a craps game in which outcomes of possible combinations of numbers which appear on two dice are assigned to post positions, comprising the steps of:

(a) providing at least one of dice, cards and a random number generator for providing an occurrence of outcomes and a game layout demarcated with areas for one or more players to wager on an occurrence of the following outcomes or combination of outcomes for at least one post position:

Odd Numbers (3-5-7-9-11),
Seven and Inside Numbers (5-6-7-8-9),
Seven and Outside Numbers (4-5-7-9-10),
Seven and Over (7-8-9-10-11-12),
Seven and Under (2-3-4-5-6-7), and
Seven & Even Numbers (7-2-4-6-8-10-12);

(b) each player making a wager on at least a selected one of the outcomes or combinations of possible outcomes for the at least one post position;

(c) generating an outcome from the possible combinations of numbers which appear on two dice for the at least one post position for a single game;

(d) assigning the generated outcome to the at least one post position for the single game;

(e) comparing the outcomes or combination of outcomes selected by each player for the at least one post position to the generated outcome assigned to the at least one post position for the single game;

(f) if the outcome does not total seven, paying each player only if the generated outcome for each of the at least one post position for the single game is in the player selected outcome or combination of possible outcomes for the at least one post position selected by the player; and (g) if the outcome totals seven for the at least one post position, paying all players who wagered on the at least one post position.

* * * * *